US012134450B2

(12) United States Patent
Sawyer et al.

(10) Patent No.: US 12,134,450 B2
(45) Date of Patent: Nov. 5, 2024

(54) PROPULSION DEVICES HAVING ELECTRIC MOTORS FOR MARINE VESSELS AND METHODS FOR MAKING THE SAME

(71) Applicant: Brunswick Corporation, Mettawa, IL (US)

(72) Inventors: Kass W. Sawyer, Neenah, WI (US); Laura K. Mueller, Fond du Lac, WI (US); David J. Waldvogel, Fond du Lac, WI (US); John O. Scherer, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 582 days.

(21) Appl. No.: 17/469,479

(22) Filed: Sep. 8, 2021

(65) Prior Publication Data

US 2023/0070725 A1 Mar. 9, 2023

(51) Int. Cl.
*B63H 21/17* (2006.01)
*B63H 20/32* (2006.01)

(52) U.S. Cl.
CPC ..... *B63H 21/17* (2013.01); *B63H 20/32* (2013.01)

(58) Field of Classification Search
CPC ..... B63H 21/17; B63H 20/32
See application file for complete search history.

(56) References Cited

U.S. PATENT DOCUMENTS

| | | | | |
|---|---|---|---|---|
| 6,924,579 | B2 | 8/2005 | Calley | |
| 6,966,806 | B1 | 11/2005 | Bruestle et al. | |
| 7,435,147 | B1 | 10/2008 | Eichinger | |
| 7,863,797 | B2 | 1/2011 | Calley | |
| 8,267,732 | B1 | 9/2012 | Poirier et al. | |
| 8,952,590 | B2 | 2/2015 | Calley et al. | |
| 8,994,243 | B2 | 3/2015 | Calley et al. | |
| 9,226,673 | B2 | 1/2016 | Ferguson et al. | |
| 9,618,003 | B2 | 4/2017 | Janecek et al. | |
| 2004/0263012 | A1* | 12/2004 | Dommsch | H02K 21/145 310/156.22 |
| 2015/0147188 | A1 | 5/2015 | Danielsson | |

FOREIGN PATENT DOCUMENTS

| | | | | |
|---|---|---|---|---|
| CN | 109733580 | A | 5/2019 | |
| EP | 1250256 | A1 | 10/2002 | |
| JP | 1988247197 | B2 | 10/1998 | |
| WO | WO-0226558 | A1 * | 4/2002 | B63H 20/007 |
| WO | WO2016180750 | | 11/2016 | |

OTHER PUBLICATIONS

Kastinger, G., "Design of a Novel Transverse Flux Machine," Body, Electronics, Engineering Advanced Development, {Aug. 2, 2018}.
Extended European Search Report for corresponding European Application No. 22193816.0, mailed Mar. 14, 2023.

* cited by examiner

*Primary Examiner* — Stephen P Avila
(74) *Attorney, Agent, or Firm* — Andrus Intellectual Property Law, LLP

(57) ABSTRACT

A propulsion device for rotating a propulsor to propel a marine vessel. The propulsion device includes a drive housing having a cavity that extends along a first central axis. A motor is positioned within the cavity. The motor rotates a shaft extending along a second central axis that is non-coaxial with the first central axis. The shaft is configured to rotate the propulsor to propel the marine vessel.

20 Claims, 6 Drawing Sheets

PROPULSION DEVICES HAVING ELECTRIC MOTORS FOR MARINE VESSELS AND METHODS FOR MAKING THE SAME

FIELD

The present disclosure generally relates to propulsion devices for marine vessels, and more particularly to propulsion devices having an electric motor.

BACKGROUND

The following U.S. Patents provide background information and are incorporated by reference in entirety.

U.S. Pat. No. 6,966,806 discloses a marine propulsion device made of first and second portions which are removably attachable to each other. The second portion is the leading edge portion of the nose cone and the drive shaft housing. The second portion is configured to crush more easily in response to an impact force than the first portion. This can be accomplished by making the second portion from a different material than the first portion, which can be aluminum, or by providing one or more crush boxes within the structure of the second portion to cause it to yield more quickly to an impact force and thus protect the first portion which is the more critical structure of the marine device.

U.S. Pat. No. 7,435,147 discloses a marine propulsion device provided with a breakaway skeg having first and second attachment points. The first and second attachment points are configured to result in the second attachment points disengaging from a gearcase or housing structure prior to the first attachment point. The arrangement of attachment points allows a reaction force at the second pin to be predetermined in a way that assures the detachment of the skeg from the housing structure prior to the detachment of the housing structure from another structure, such as the boat hull, or transom.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a propulsion device for rotating a propulsor to propel a marine vessel. The propulsion device includes a drive housing having a cavity that extends along a first central axis. A motor is positioned within the cavity. The motor rotates a shaft extending along a second central axis that is non-coaxial with the first central axis. The shaft is configured to rotate the propulsor to propel the marine vessel.

Another embodiment generally relates to a method for making a propulsion device for rotating a propulsor to propel a marine vessel. The method includes providing a drive housing having a cavity that extends along a first central axis. The method further includes providing a motor that rotates a shaft extending along a second central axis, where the shaft is configured to rotate the propulsor to propel the marine vessel. The method further includes positioning the motor within the cavity such that the second central axis is non-coaxial with the first central axis.

Another embodiment generally relates to a propulsion device for a marine vessel. The propulsion device includes a drive housing having a fixed portion and a removable portion coupled to the fixed portion. The fixed portion has a cavity with a circular cross section that extends along a first central axis. The removable portion has an opening with an upper surface, a lower surface, and a circular cross section. A notch extends radially outwardly from the opening in the removable portion. A motor is positioned within the opening of the removable portion, where the motor is a transverse flux motor having a body with wires extending radially outwardly therefrom. The wires are positioned within the notch. The motor rotates a shaft extending along a second central axis, where the shaft is configured to rotate the propulsor to propel the marine vessel. A cap is coupled to the removable portion and radially aligns the shaft within the drive housing such that the second central axis is parallel and non-coaxial with the first central axis.

Various other features, objects and advantages of the disclosure will be made apparent from the following description taken together with the drawings.

BRIEF DESCRIPTION OF THE DRAWINGS

The present disclosure is described with reference to the following drawings.

DETAILED DISCLOSURE

Figure 1:
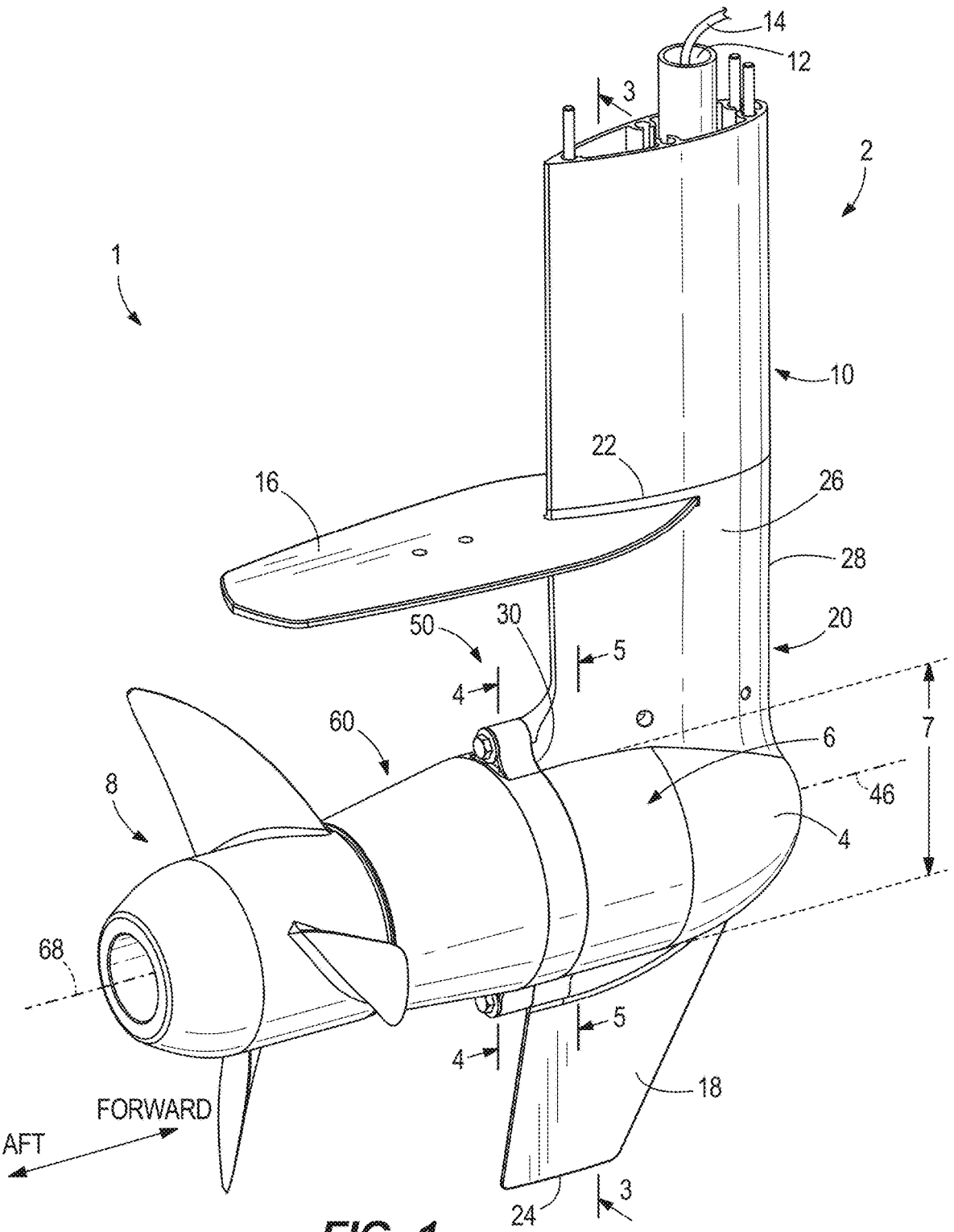
FIG. 1 is a rear perspective view of part of a propulsion device according to the present disclosure.

The present disclosure generally relates to propulsion devices, and specifically to propulsion devices having an electric motor within a drive housing. The present inventors have recognized that it would be advantageous to use a transverse flux motor (TFM), which have not been used in marine propulsion devices to date. In particular, the inventors realized that TFMs offer high levels of torque and high efficiency at low RPMs, which would be beneficial in a marine propulsion context. In particular, the present inventors have recognized that providing high torque at low rpm facilitates a direct drive design, eliminating the need for a gear reduction unit between the motor and the propeller in many situations. TFM motors are also compact, which reduces hydrodynamic drag, weight, and in certain examples, cost.

The paper *Design of a Novel Transverse Flux Machine* by G. Kastinger at Robert Bosch GmbH provides background information for TFMs generally, which is available at: web.mit.edu/kirtley/binlustuff/literature/electric %20machine/Design_of_Tranverse_Flux_Machine.pdf.

Transverse flux motors of TFMs have historically been difficult to commercialize, and thus are costly compared to more standard axial flux motors (AFMs). Electric Torque Machines of Flagstaff, Arizona (a Graco Company) produces TFMs for use in other industries. The physical construction of TFMs necessarily results in larger and generally less convenient packaging compared to AFMs. In particular, TFMs have an external stator portion with wire connections that protrude out the side of the stator. The wires exiting out the side of the stator, rather than out of one of the ends as in AFMs, was found by the inventors to be problematic in the context of a propulsion device for a marine vessel. Specifically, the inventors realized that the wires cause the TFMs to have a non-circular cross section, whereas the drive housing cavity in which the motor is to be installed preferably has a circular cross section.

AFMs are customarily positioned within a drive housing cavity, which customarily has a circular cross section, such that the shaft rotated by the AFM is coaxially aligned with a central axis of the drive housing cavity. Therefore, a TFM with a non-circular cross section can also be positioned within a drive housing cavity having a circular cross section (with the shaft of the TFM coaxially aligned with the central axis of the drive housing cavity) by increasing the diameter of the cavity to accommodate the wiring of TFM on one side of the TFM. However, particularly in the case of a marine propulsion device, the present inventors found that it would not be desirable to increase the size of the drive housing cavity (and thus the size of the drive housing) any more than necessary to accommodate the TFM wiring. Instead, it is preferred to have the smallest cavity possible, which enables the smallest possible drive housing, not only to reduce the material and labor cost of manufacturing, but also to minimize drag and improve hydrodynamic performance through the water.

Figure 6:
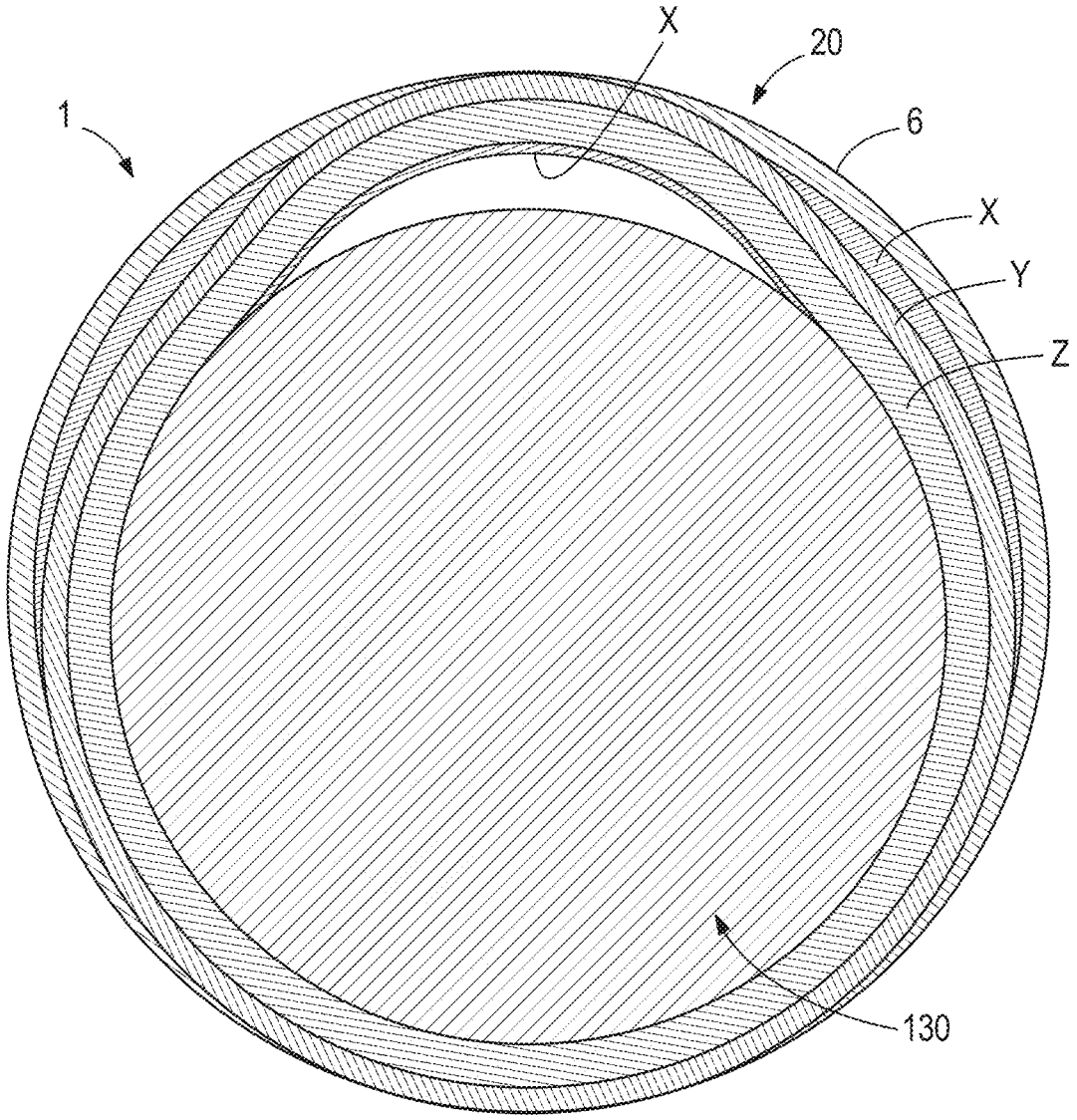
FIG. 6 is a sectional forward facing view depicting another embodiment of a propulsion device according to the present disclosure.

The present disclosure is a result of efforts by the present inventors to overcome these challenges, and provides improved propulsion devices and methods for making propulsion devices that accommodate a TFM within a drive housing. In certain examples, an egg-shaped drive housing cavity is provided within the drive housing (FIG. 6). The exterior of the drive housing surrounding the drive housing cavity (also referred to as a torpedo) is then smallest when correspondingly egg-shaped. The egg-shape drive housing cavity accommodates the stator and wiring of the TFM, but has a smaller cross sectional area than a drive housing cavity having a circular cross section large enough to accommodate the wiring of the TFM. However, one challenge with incorporating an egg-shaped drive housing cavity was difficulty in sealing portion of the drive housing when assembled with the motor therein. Other designs and methods developed by the present inventors as discussed further below provide for non-coaxial (in some cases further described as offset) central axes of the drive housing cavity and shaft rotated by the motor. The present inventors have recognized that offsetting the central axes allows a moderately small sizing increase, but still a simple, circular cross section of the drive housing cavity, which provides more reliable sealing and cost savings for materials and labor.

FIG. 1 depicts a propulsion device 1 according to the present disclosure, which includes a drive housing 2 having an upper casing 10 and a lower casing 20 that are coupled together in a manner known in the art. A conduit 12 extends through the upper casing 10, through which wires 14 may extend through the drive housing 2, for example to provide power and/or communication to a motor contained within the lower casing 20, as discussed further below. The conduit 12 is also used to vent pressure within the drive housing.

The lower casing 20 extends between a top 22 and a bottom 24, and a front 28 and a back 30, with sides 26 therebetween. The lower casing 20 also includes a nose 4 at the front 28 that smoothly transitions to a curved exterior, shown here as a torpedo 6, extending radially outwardly from the sides 26, the torpedo 6 having an outer diameter 7. The lower casing 20 further includes an anti-ventilation plate 16 and a skeg 18.

Figure 2:
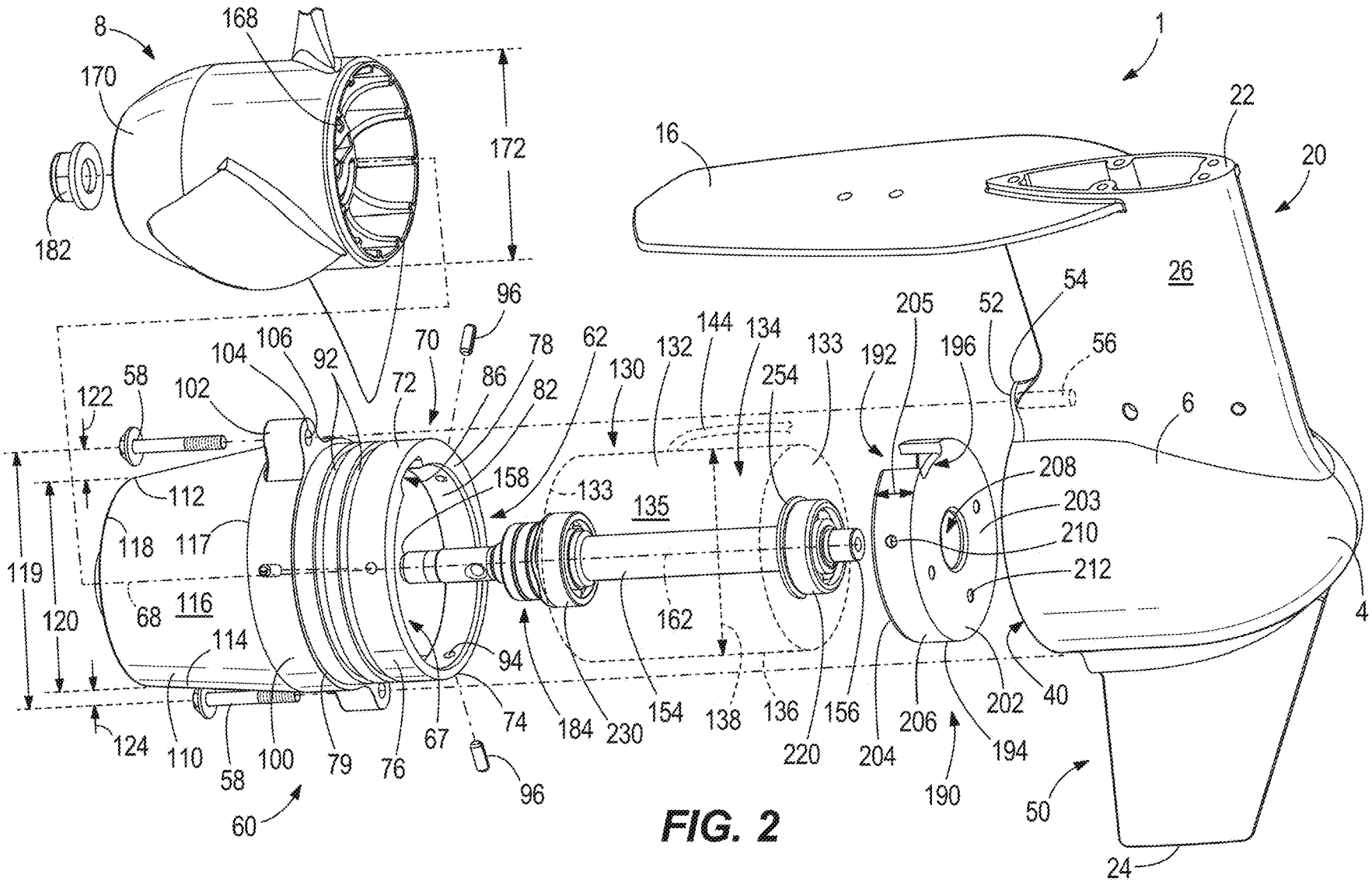
FIG. 2 is an exploded side view of the propulsion device of FIG. 1.

The lower casing 20 is further divisible into a fixed portion 50 and a removable portion 60 coupled to extend rearwardly from the fixed portion 50. As shown in FIG. 2, the removable portion 60 is separable from the fixed portion 50 to provide access to the motor 130 positioned within the lower casing 20. The motor 130 has a body 132 that extends between a top 134 and a bottom 136, generally having a cylindrical shape extending between ends 133 and having a diameter 138. The motor 130 is specifically a transverse flux motor in which the wiring 144 exits the body 132 at a position along its side 135 between the ends 133, rather than through one of the ends 133 as in a standard axial flux motor. In particular, the wiring 144 extends from the body 132 to an end 152, for example to extend upwardly through the conduit 12 in the upper casing 10 to provide power and/or communication to the motor 130.

With continued reference to FIG. 2, the motor 130 rotates a shaft 154 within the body 132. The shaft 154 extends between a first end 156 and a second end 158 defining an central axis 162 therebetween. The propeller 8 is coupled to the shaft 154 via a fastener 182 at the back 170 of the propeller 8. The shaft 154 rotates the propeller 8 to propel a marine vessel through water in a manner known in the art. The shaft 154 may be directly coupled at the second end 158 to the propeller 8, or the shaft 154 may be divided into a motor shaft rotated by the motor 130, which in turn rotates a separate propeller shaft coupled to the propeller 8. It should be recognized that propulsors other than the propeller 8 shown are also contemplated by the present disclosure, including those having differing numbers of blades, blade pitches, and/or the like. Likewise, a transmission having one or more speeds may be operatively coupled between the motor 130 and the propeller 8.

Figure 4:
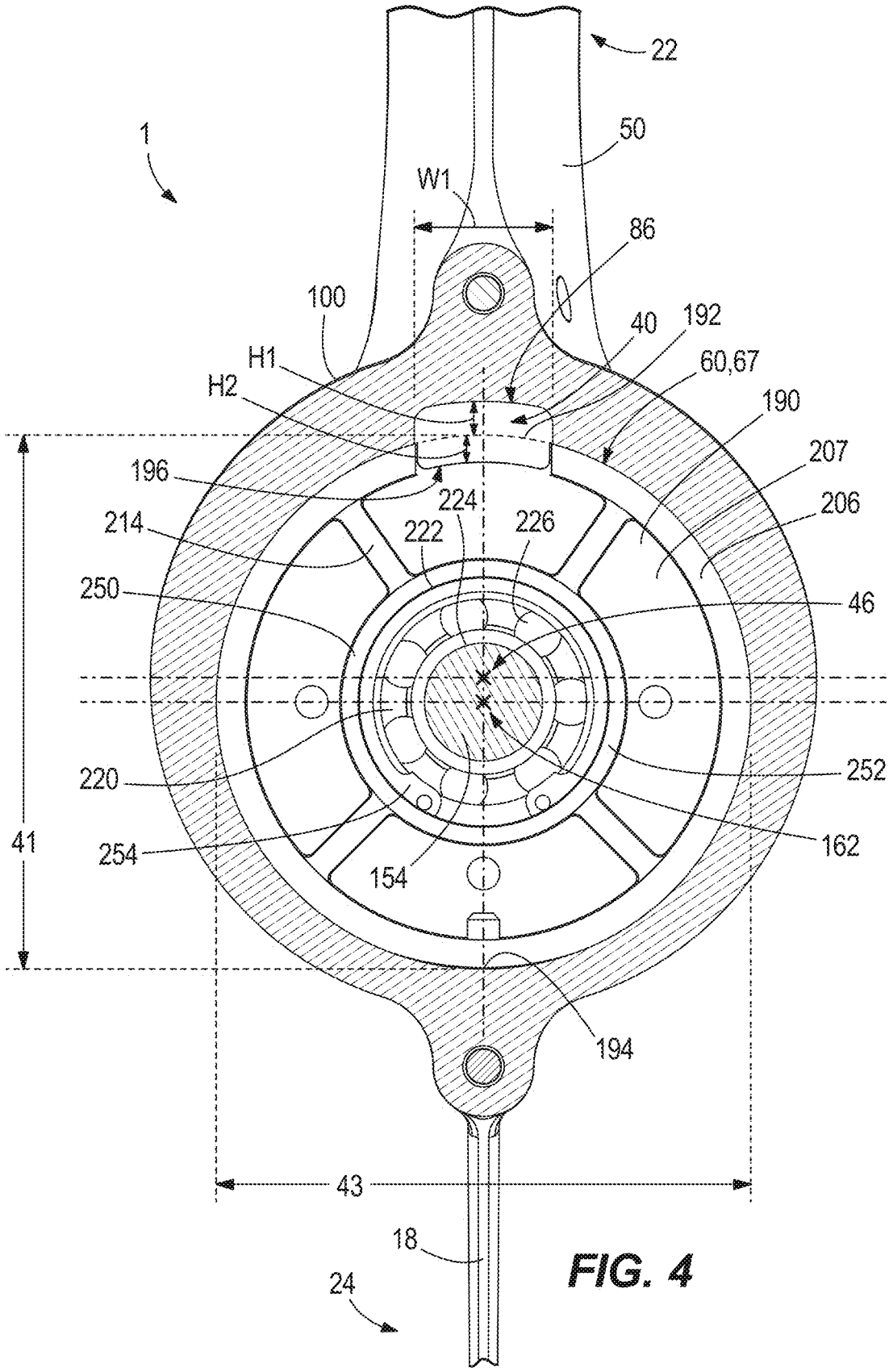
FIG. 4 is a sectional forward facing view taken along the line 4-4 in FIG. 1.
Figure 5:
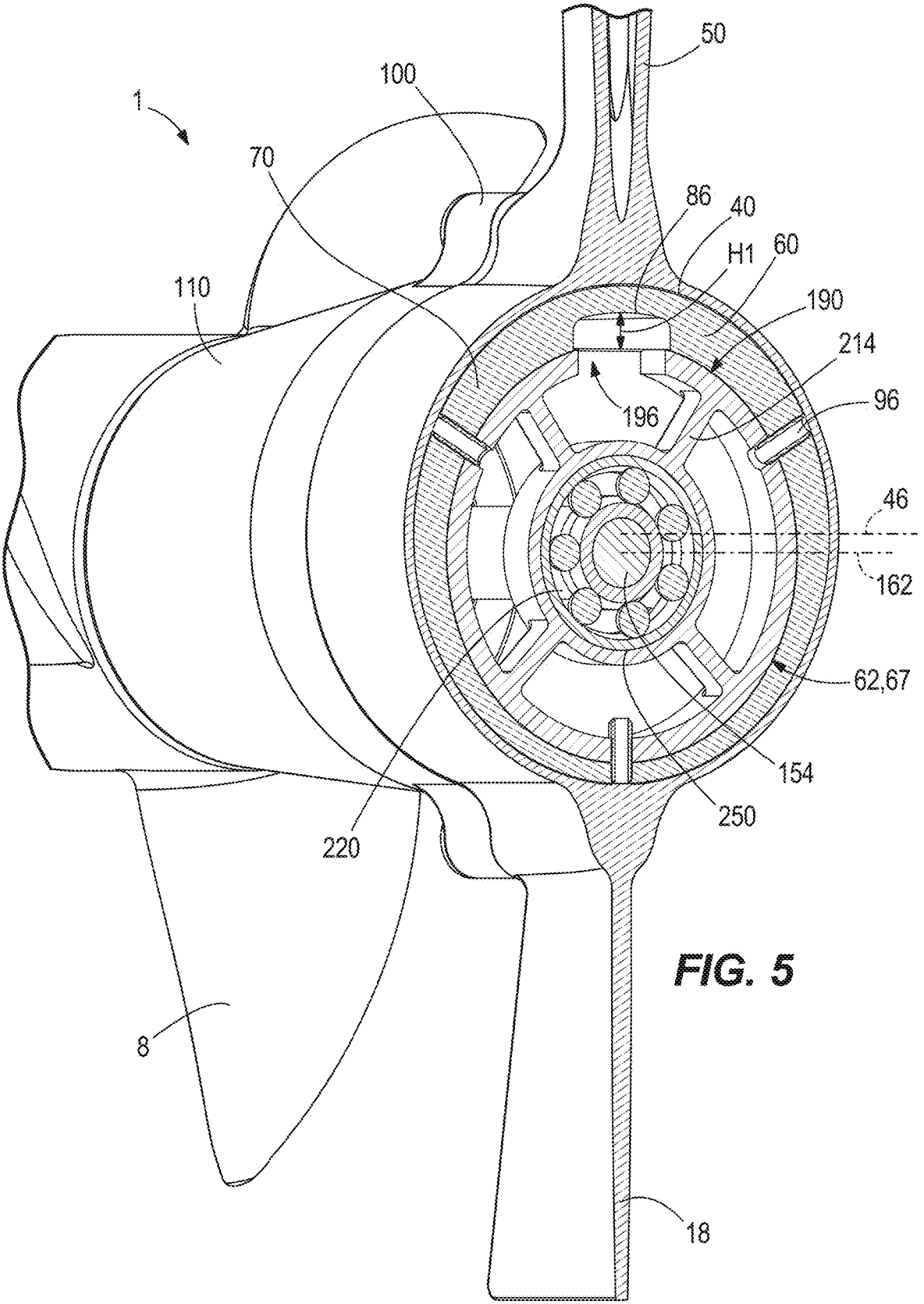
FIG. 5 is a sectional rear facing view taken along the line 5-5 in FIG. 1.

The shaft 154 is axially supported relative to the body 132 of the motor 130 via a first bearing 220 and a second bearing 230. Additional detail for the first bearing 220 is shown in FIG. 4, which may be a conventional bearing having an outer diameter 222, inner diameter 224, and balls 226. In certain examples, the bearings are sealed and lubricated for life, and further are designed to minimize rotor deflection under load. This maintains a consistent air gap for optimal motor performance. These bearings may be of a needle bearing type, or others known in the art. In addition to the second bearing 230 being at the aft end 133 of the motor 130, a gasket 184 or another sealing element may be provided to create a seal between the shaft 154 and the removable portion 60 of the lower casing 20, as discussed further below.

As shown in FIG. 4, a cavity 40 is formed in the fixed portion 50 of the lower casing 20, the cavity 40 spans a width 43 as well as a height 41 between an upper surface 42 and lower surface 44. The cavity 40 presently shown has a circular cross section and is cylindrically shaped, extending along a central axis 162 going into the page. It should be recognized that when having a circular cross section, the height 41 and width 43 are the same (and thus also referred to as a diameter of the cavity 40). As will become apparent, the cavity 40 is configured such that part of the removable portion 60 is positioned therein when the fixed portion 50 and the removable portion 60 are coupled together.

As shown in FIG. 2, the fixed portion 50 of the lower casing 20 further includes a flange 54 having a mating face 52 with openings 56 defined therein. The openings 56 are configured to accept fasteners 58 therein, for example in a threaded arrangement. The mating face 52 of the fixed portion 50 is configured to mate with a flange 100 of the removeable portion 60 to couple the fixed portion 50 and removeable portion 60 together.

The removable portion 60 of FIG. 2 includes a first region 70 that extends between a top 72 and a bottom 74, has an outer surface 76 and an inner surface 82, and extends between a front 78 and a back 79, which here is generally cylindrically shaped having a circular cross section. A cavity 62 is defined by an inner surface 82 within the removable portion 60, which includes an opening 67. The opening 67 here has a circular cross section extending along a central axis 68 defined centrally therethrough in the fore-aft direction.

With continued reference to FIG. 2, the cavity 62 further includes a notch 86 that extends radially outwardly from the opening 67. The notch 86 is particularly recessed a height H1 from the opening 67, having a width W1 and a height H1 together configured to accommodate the wiring 144 from the motor 130 therein (see FIG. 3).

FIG. 2 further shows grooves 92 defined within the outer surface 76 of the first region 70 of the removable portion 60, which are configured for receiving gaskets such as O-rings (not shown) for sealing between the removable portion 60 and the fixed portion 50 when coupled together. Openings 94 are also defined extending through the inner surface 82 and outer surface 76 of the first region 70, which are configured to accept pins 96 therein, for example as threaded set screws.

FIG. 2 further shows a flange 100 positioned at the back 79 of the first region 70, which includes two ears 102 each having a mating face 104 and defining openings 106 therethrough. The openings 106 are configured for receiving the fasteners 58 previously discussed therethrough, which couple the fixed portion 50 to the removable portion 60. In particular, the mounting face 104 on the flange 100 of the removable portion 60 is drawn flush with the mounting face 52 of the fixed portion 50, held in place by the fastener 58 (e.g., a threaded bolt or screw). While the fasteners 58 are presently shown to be positioned at the top and bottom of the removable portion 60, other locations and numbers are also contemplated, as are alternative methods for removably coupling the removable portion 60 and fixed portion 50 (e.g., clamps or brackets).

In this manner, the first region 70 of the removable portion 60 is received within the cavity 40 defined in the fixed portion 50 of the lower casing 20. The present inventors have discovered that this design provides cost effective, reliably sealed, and easy to machine assembly of the propulsion device 1 due to the cavity 40 having a circular cross section. This design also provides for simple and more reliable sealing and subsequent access to the motor 130 for maintenance and/or replacement as necessary. Moreover, the present inventors have recognized that by offsetting the motor 130 downwardly within the drive housing 2, material and weight can be saved with respect to positioning the propeller 8 a given distance below the water surface (e.g., versus having a longer upper casing 10).

With continued reference to FIG. 2, further aft of the flanges 100, opposite from the first region 70, is a second region 110. The first region 70, flange 100, and second region 110 may be integrally formed or coupled together using techniques presently known in the art. The second region 110 has a frustoconical shape extending between a top 112 and a bottom 114, a front 117 and a back 118, and sides 116 extending therebetween. The front 117 has a circular cross section with an outer diameter 119 (e.g., between the top 112 and the bottom 114). The back 118 also has a circular cross section with an outer diameter 120, which here is less than the outer diameter 119 of the front 117. In particular, the top 112 slopes radially inwardly from the front 117 to the back 118, reducing a delta 122 therebetween. The bottom 114 also slopes radially inwardly from the front 117 to the back 118, reducing a delta 124 therebetween. The delta 122 from the slope of the top 112 is shown to be greater than the delta 124 for the slope of the bottom 114. However, it should be recognized that the absolute or relative deltas 122, 124 may vary. Likewise, the sides 116 may slope rather than the top 112 and bottom 114. In general, the slopes provide a transition between the larger cavity 40 in the fixed portion 50 that receives the removable portion 60 therein, and the back 118 of the second region 110 of the removable portion 60 (which need not accommodate the wiring 144).

FIG. 2 further shows the back 118 of the second region 110 generally corresponding to an outer diameter 172 at the front 168 of the propeller 8. The diameters of the front 168 of the propeller 8 and the back 118 of the second region 110 generally align when the propeller 8 is coupled to the propulsion device 1. In certain embodiments, the diameter at the back 118 of the second region is less than a diameter 138 of the motor 130.

As shown FIGS. 2 and 4, a cap 190 extends between a top 192 and a bottom 194, as well as between a front 202 and a back 204, with sides 206 extending aftwardly from a plate 203 at the front 202. A notch 196 is defined radially inwardly from the top 192 of the cap 190, which is configured to correspond to and align with the notch 86 in the first region 70 of the removable portion 60. As shown in FIG. 4, the notch 196 of the cap 190 extends a height H2 radially inwardly from the top 192 to provide clearance for the wiring 144 of the motor 130. It should be recognized that other locations for positioning the notches 86, 196 also contemplated by the present disclosure, providing clearance for a non-cylindrically shaped motor 130 having wiring 144 that exits the side 135 thereof.

Figure 3:
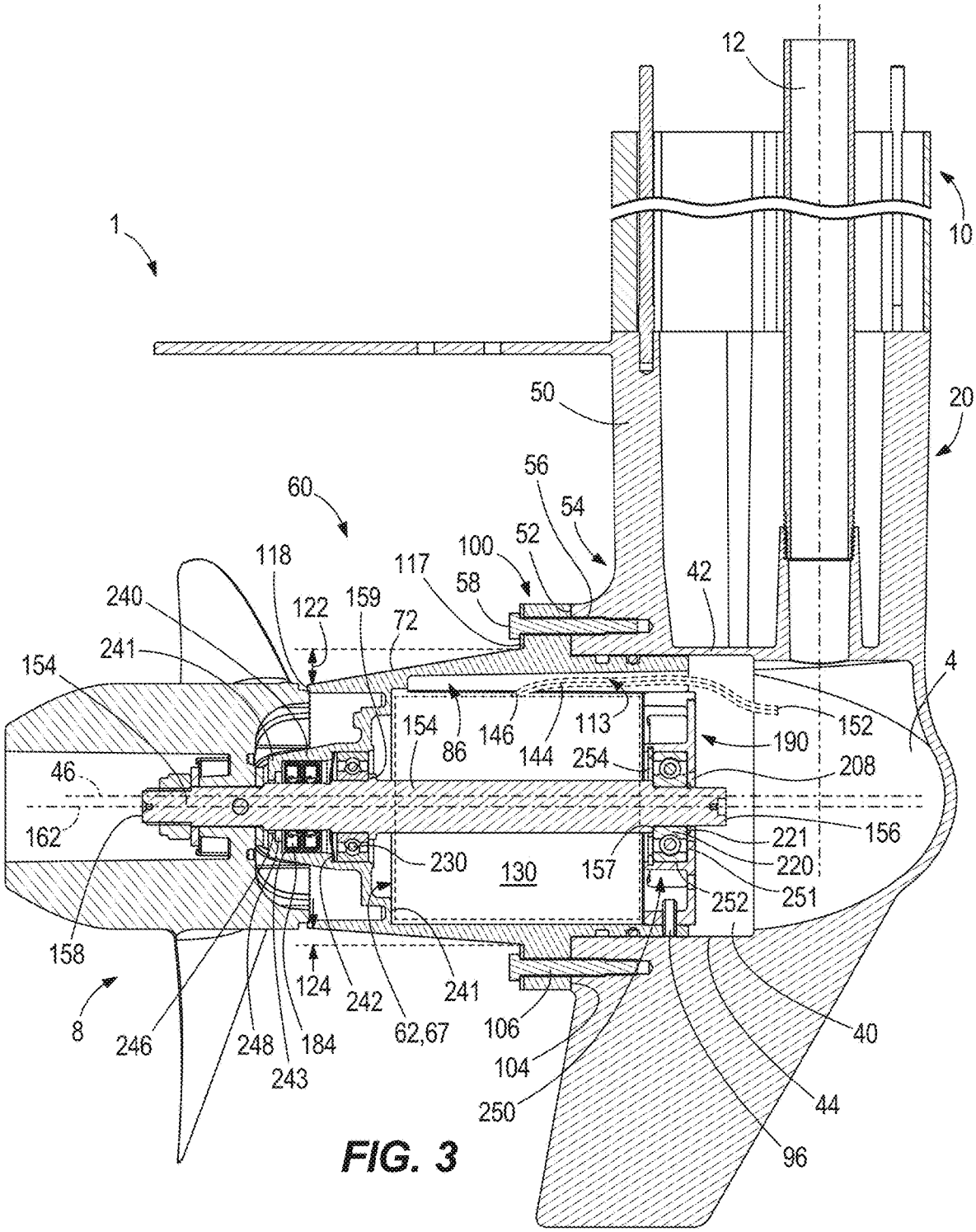
FIG. 3 is sectional side view taken along the line 3-3 in FIG. 1.

In this manner, FIG. 4 shows that the notches 86, 196 enable the cavity 40 in the fixed portion 50, as well as the opening 67 of the cavity 62 in the removable portion 60, to have simple cylindrical shapes of circular cross section, accommodating the height H3 and width of the wiring 144 extending from the side 135 of the motor 130 therein. As shown in FIG. 3, this provides that the central axis 68 of the cavity 62 in the removable portion 60 is offset, or non-coaxial, from the central axis 46 of the cavity 40 in the fixed portion 50. The central axis 68 and central axis 46 are shown here to be parallel.

Returning to FIG. 2, the front 202 of the cap 190 has an opening 208 located centrally therethrough, through which the first end 156 of the shaft 154 rotated by the motor 130 extends. Additional openings 210 are provided in the sides 206 of the cap 190, which align with the openings 94 in the outer surface 76 of the removable portion 60. In this manner, insertion of pins 96 through the openings 94 and openings 210 provide for rotational alignment and fixation between cap 190 and the first region 70 of the removable portion 60. The motor 130 is retained within the cavity 62 of the removable portion 60 when the cap 190 is coupled to first region 70.

In addition to providing rotational alignment, the cap 190 provides for controlled and consistent alignment of the central axis 162 of the shaft 154 relative to the central axis 46 through the center of the cavity 40 in the fixed portion 50. Additional openings 212 are also provided within the front 202 of the cap 190 for mounting of various electronic devices, such as sensors. These electronic devices may be provided to monitor and control the performance of the motor 130 in a manner presently known in the art.

As shown in FIG. 3, towards the back 118 of the second region 110 of the removable portion 60 is a basket 240 that aligns and rotatably supports the shaft 154 rotated by the motor 130. The basket 240 has a first shelf 241 that extends perpendicularly radially inwardly from the sides 116 in the second region 110, which provides a backstop for the motor 130 within the cavity 62. A second shelf 242 is provided after the basket 240 tapers further radially inwardly as it extends towards the back 118 of the second region 110, in this case being configured to seat and engage with the second bearing 230. The second bearing 230 has a press-fit arrangement to be retained in position relative to the basket 240, and thus relative to the second region 110 and the removable portion 60, such that the shaft 154 rotates within the second bearing 230.

With continued reference to FIG. 3, moving further aftwardly from the second shelf 242, the basket 240 further includes a third shelf 243 that extends even further radially inwardly from the second shelf 242 and first shelf 241. The shaft 154 extends through the basket 240 via an opening 246 centrally located therethrough, aft of the third shelf 243. The third shelf 243 is configured for seating and retaining the gasket 184 surrounding the shaft 154. The gasket 184 provides a seal between the shaft 154 and the basket 240 to prevent water from entering the removable portion 60, and thus from entering the lower casing 20. A C-clip or spring 248 is positioned about the shaft 154 near its second end 258 and the second bearing 230. The spring 248 may be received in a groove defined in the shaft 154, or fixed through other techniques presently known in the art. A flange 159 extends radially outwardly from the shaft 154. The spring 248 is used to preload the second bearing 230.

FIG. 3 further shows a basket 250 within the cap 190 for axially receiving and rotationally supporting the shaft 154 therein. The basket 250 is centrally supported within the cap 190 by a series of ribs 214 (see FIG. 4) and includes a shelf 251 and walls 252 for receiving the first bearing 220 therein. The opening 208 within the cap 190 discussed above is centrally formed within the basket 250. When the cap 190 is fixed to the removable portion 60 in the manner previously discussed. A C-clip 254 engages with walls 252 of the basket 250 to retain the first bearing 220 within the basket 250, for example be received within grooves defined in the walls 252. In this manner, the first bearing 220 is fixed between the shelf 251, walls 252 and the C-clip 254 such that the first bearing 220 rotationally supports the shaft 154 therein. A flange 157 extending radially outwardly from the shaft 154 substantially near the first end 156 thereof. A C-clip 221 is provided near the first end 156 of the shaft 154 on the front side of the bearing 220 to limit the forward and aft movement of the shaft 154.

In certain examples, the first end 156 of the shaft 154 extends forwardly from the opening 208 in the cap 190 to enable various electrical components as discussed above. Additionally clearance is provided within the cavity 40 forward of the cap 190 to accommodate these electric components.

When fully assembled as shown in FIG. 3, the central axis 162 of the shaft 154 rotated by the motor 130 is positioned non-coaxially (and in this case lower) compared to the central axis 46 of the cavity 40 in the lower casing 20. By offsetting the position of the central axis 162 relative to the central axis 46 of the cavity 40 in the lower casing 20, the present inventors have recognized that a transverse flux type motor can be accommodated within a principally simple, circular design, despite the motor 130 itself having a non-circular cross section (unlike a standard axial motor).

In this manner, the methods and designs presented herein not only offer a solution for integrating TFMs into marine propulsion devices, but also provide for each of repair or replacement within the field. For example, the entire motor 130, shaft 154, and any corresponding electrics may be removed and replaced as an assembly simply be removing the fasteners 58 and separating from the removable portion 60 from the fixed portion 50 of the lower casing 20. This eliminates the need to separate the shaft 154 from the first bearing 220 and second bearing 230, gasket 184, and the like. Moreover, the entire motor 130, shaft 154, and removeable portion 60 may be manufactured as a subassembly for simple insertion into a lower casing 20. In certain cases, this may allow for flexibility in offering differing wattages of motors 130 at assembly, or easy in-field upgrades.

FIG. 6 shows another propulsion device 1 according to the present disclosure, which in this case provides a cavity 40 having an egg-shaped cross section in the drive housing 2 for accommodating the wiring 144 of a TFM. It should be recognized that while the cavity 40 is shown to have an egg-shaped cross section, the torpedo 6 may have a circular cross section, an egg-shaped cross section, or other configurations. For example, elements X and Z show two alternative shapes of the removeable portion 60 with Y as the o-rings 92 discussed above.

It should be recognized that while the foregoing has described a propeller 8 that is aft of the lower casing 20, the present disclosure also relates to propulsion devices configured in a tractor or pulling type configuration. Likewise, while the foregoing depicted configurations or propulsion devices 1 having direct drive propulsors, the present disclosure also relates to designs having transmissions and/or different gear or pulley configurations operatively arranged between the motor 130 and the propeller 8, for example.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A propulsion device for rotating a propulsor to propel a marine vessel, the propulsion device comprising:

a drive housing having a cavity that extends along a first central axis; and a motor positioned within the cavity, wherein the motor rotates a shaft extending along a second central axis that is non-coaxial with the first central axis, and wherein the shaft is configured to rotate the propulsor to propel the marine vessel;

wherein the drive housing comprises a fixed portion and a removable portion removably coupled to the fixed portion, wherein the cavity is defined in the fixed portion and the motor is coupled to the removable portion.

2. The propulsion device according to claim 1, wherein the cavity has a circular cross section, and wherein the motor has a body with a circular cross section.

3. The propulsion device according to claim 2, wherein the cavity is defined in part by an upper surface and a lower surface, and wherein the shaft is closer to the lower surface than to the upper surface.

4. A propulsion device for rotating a propulsor to propel a marine vessel, the propulsion device comprising:

a drive housing having a cavity that extends along a first central axis;

a motor positioned within the cavity, wherein the motor rotates a shaft extending along a second central axis that is non-coaxial with the first central axis, wherein the shaft is configured to rotate the propulsor to propel the marine vessel, and wherein the motor has a body; and wiring that extends radially outwardly from the body of the motor.

5. The propulsion device according to claim 1, further comprising a cap coupled to the drive housing that radially aligns the shaft within the cavity.

6. A propulsion device for rotating a propulsor to propel a marine vessel, the propulsion device comprising:

a drive housing having a cavity that extends along a first central axis;

a motor positioned within the cavity, wherein the motor rotates a shaft extending along a second central axis that is non-coaxial with the first central axis, and wherein the shaft is configured to rotate the propulsor to propel the marine vessel;

a cap coupled to the drive housing that radially aligns the shaft within the cavity, wherein the cap defines an opening through which the shaft extends; and a first bearing coupled to the cap that rotatably supports the shaft.

7. The propulsion device according to claim 6, where the drive housing comprises a fixed portion and a removable portion removably coupled to the fixed portion, wherein the cavity is defined in the fixed portion and the motor is coupled to the removable portion.

8. The propulsion device according to claim 7, wherein the motor has a body, further comprising wiring that extends radially outwardly from the body of the motor, wherein an opening in which the motor is positioned is defined in the removable portion, and wherein a notch in which the wiring is positioned is defined extending radially outwardly from the opening in the removable portion.

9. The propulsion device according to claim 7, wherein the removable portion has a first end and a second end, the first end being closer than the second end to the fixed portion, and wherein an opening is defined through the second end that receives the shaft therethrough.

10. The propulsion device according to claim 9, wherein the first end and the second end of the removable portion each have a circular cross section.

11. The propulsion device according to claim 10, wherein the circular cross section of the first end has a diameter that is greater than a diameter of the circular cross section of the second end.

12. The propulsion device according to claim 11, wherein the second end has a top and a bottom, and wherein the shaft is closer to the bottom than to the top.

13. The propulsion device according to claim 6, wherein a second bearing is coupled to the removable portion and rotatably supports the shaft.

14. The propulsion device according to claim 1, wherein the first central axis is parallel to the second central axis.

15. The propulsion device according to claim 1, wherein the motor is a transverse flux motor.

16. A method for making a propulsion device for rotating a propulsor to propel a marine vessel, the method comprising:

providing a drive housing having a cavity that extends along a first central axis, wherein the drive housing comprises a fixed portion and a removable portion configured to be removably coupled to the fixed portion, and wherein the cavity is defined in the fixed portion;

coupling a motor to the removable portion of the drive housing, wherein the motor is configured to rotate a shaft that extends along a second central axis, wherein the shaft is configured to rotate the propulsor to propel the marine vessel; and coupling the removable portion of the drive housing to the fixed portion such that the motor is positioned within the cavity and the second central axis is non-coaxial with the first central axis.

17. The method according to claim 16, wherein the motor has a body with a circular cross section, wherein the cavity has an upper surface and a lower surface and a circular cross section, and wherein the shaft is closer to the lower surface than to the upper surface.

18. A method for making a propulsion device for rotating a propulsor to propel a marine vessel, the method comprising:

providing a drive housing having a cavity that extends along a first central axis;

providing a motor that rotates a shaft extending along a second central axis, wherein the shaft is configured to rotate the propulsor to propel the marine vessel;

positioning the motor within the cavity such that the second central axis is non-coaxial with the first central axis, wherein the drive housing has a fixed portion and a removable portion removably coupled to the fixed portion, and wherein the cavity is defined in the fixed portion and the motor is coupled to the removable portion; and coupling a cap to the removable portion, wherein the cap radially aligns the shaft within the drive housing such that the second central axis is parallel with the first central axis.

19. The method according to claim 18, wherein the motor has a body and is a transverse flux motor with wiring that extends radially outwardly from the body, wherein an opening in which the motor is positioned is defined in the removable portion, and wherein a notch in which the wiring is positioned is defined extending radially outwardly from the opening in the removable portion.

20. A propulsion device for a marine vessel, the propulsion device comprising:

a drive housing having a fixed portion and a removable portion coupled to the fixed portion, the fixed portion having a cavity with a circular cross section that extends along a first central axis, the removable portion having an opening with an upper surface, a lower surface, and a circular cross section, and wherein a notch extends radially outwardly from the opening in the removable portion;

a motor positioned within the opening of the removable portion, wherein the motor is a transverse flux motor having a body with wires extending radially outwardly therefrom, wherein the wires are positioned within the notch, wherein the motor rotates a shaft extending along a second central axis, and wherein the shaft is configured to rotate the propulsor to propel the marine vessel; and a cap coupled to the removable portion, wherein the cap radially aligns the shaft within the drive housing such that the second central axis is parallel and non-coaxial with the first central axis.

* * * * *